US011485569B2

(12) United States Patent
Han

(10) Patent No.: US 11,485,569 B2
(45) Date of Patent: Nov. 1, 2022

(54) WIPE CONTAINER ALLOWING CLEANING WIPE TO BE WITHDRAWN WITHOUT CONTACT AND SEALING METHOD THEREOF

(71) Applicant: PaaNeeCo, Inc., Incheon (KR)

(72) Inventor: Steven Joon Han, Santa Clara, CA (US)

(73) Assignee: PaaNeeCo, Inc., Incheon (KR)

( * ) Notice: Subject to any disclaimer, the term of this patent is extended or adjusted under 35 U.S.C. 154(b) by 0 days.

(21) Appl. No.: 17/394,325

(22) Filed: Aug. 4, 2021

(65) Prior Publication Data

US 2022/0297923 A1 Sep. 22, 2022

(30) Foreign Application Priority Data

Mar. 18, 2021 (KR) ..... 10-2021-0035287

(51) Int. Cl.

| | |
|---|---|
| ***A47K 10/32*** | (2006.01) |
| ***B65D 83/08*** | (2006.01) |
| ***B65B 61/20*** | (2006.01) |
| ***B65B 7/28*** | (2006.01) |

(52) U.S. Cl.

CPC ..... *B65D 83/0835* (2013.01); *A47K 10/32* (2013.01); *B65B 7/28* (2013.01); *B65B 61/20* (2013.01); *B65D 83/0894* (2013.01); *A47K 2010/3266* (2013.01)

(58) Field of Classification Search

CPC ..... A47K 10/32
USPC ..... 221/33–63
See application file for complete search history.

(56) References Cited

U.S. PATENT DOCUMENTS

| | | | | |
|---|---|---|---|---|
| 7,648,046 | B2 * | 1/2010 | Sosalla | F28D 20/023 221/36 |
| 2010/0206896 | A1 * | 8/2010 | Ray | A47K 10/3818 221/45 |
| 2014/0367400 | A1 * | 12/2014 | Grudge | B65D 47/0804 221/63 |

(Continued)

*Primary Examiner* — Gene O Crawford
*Assistant Examiner* — Ayodeji T Ojofeitimi
(74) *Attorney, Agent, or Firm* — Broadview IP Law, PC

(57) ABSTRACT

One aspect of the present disclosure provides a wipe container allowing a cleaning wipe to be withdrawn without contact, the wipe container including a container main body configured to provide a space in which the cleaning wipe is stored, a container cover detachably coupled to an upper portion of the container main body to seal the container main body and control opening and closing of the container main body, a sub-cover provided in a portion of the container cover and whose opening and closing is controlled by pressure caused by an external force to seal the container main body, and withdrawal tongs inserted into the container main body due to having a portion coupled to the sub-cover and configured to be caught on the cleaning wipe accommodated in the container main body, wherein the withdrawal tongs include a coupling portion manufactured in a shape that corresponds to the sub-cover and detachably coupled to the sub-cover, a hook formed to protrude from a portion of a lower portion of the coupling portion and inserted into the container main body to hold the cleaning wipe, and a withdrawal tongs handle formed to protrude in a predetermined shape from an upper portion of the coupling portion so as to be held.

12 Claims, 8 Drawing Sheets

(56) References Cited

U.S. PATENT DOCUMENTS

| | | | | |
|---|---|---|---|---|
| 2016/0000278 | A1* | 1/2016 | Yamada | B65D 83/0835 221/58 |
| 2016/0007812 | A1* | 1/2016 | Yamada | A47K 10/421 206/494 |
| 2016/0113450 | A1* | 4/2016 | Yamada | B65D 75/5894 221/53 |

* cited by examiner

WIPE CONTAINER ALLOWING CLEANING WIPE TO BE WITHDRAWN WITHOUT CONTACT AND SEALING METHOD THEREOF

CROSS-REFERENCE TO RELATED APPLICATION

This application claims priority to and the benefit of Korean Patent Application No. 2021-0035287, filed on Mar. 18, 2021, the disclosure of which is incorporated herein by reference in its entirety.

BACKGROUND

1. Field of the Invention

The present disclosure relates to a wipe container allowing a cleaning wipe to be withdrawn without contact and a sealing method thereof in which, when a wet wipe or cleaning wipe in a container having a predetermined shape is used for the first time, that is, when making the first wipe pass through a hole formed in a lid of the container to use the wipe, the cleaning wipe is easily pulled up through the hole in the lid without fingers directly coming in contact with the wipe.

2. Discussion of Related Art

Generally, regarding wet wipes or cleaning wipes in a cylindrical container, the first wipe of a nonwoven roll is taken out through a discharge hole in the lid and then used.

Meanwhile, a cover is present on the lid at an upper portion of the cylindrical container to prevent the wipes from drying. The cover is opened and then one wipe at a time is pulled using fingers so as to be used. The cover of the lid is opened, the first wipe is pushed through the discharge hole below the cover to take out a portion of an end of the first wipe, and then the cover is closed. For use of the wipes, the cover is opened, and then a wipe is pulled out for use.

Therefore, when, in order to take out a wipe from the cylindrical container, a user directly holds a wipe, which is rolled at the center of the cylindrical container, with his or her fingers to take out the wipe, foreign substances, germs, or the like may be transferred from the fingers to the clean wipe, and thus pulling the first wipe at an end portion of a nonwoven roll using fingers is problematic and unhygienic.

Meanwhile, due to the global pandemic, demand for cleaning and sanitizing wipes has exploded, and there is a need to address the inconvenient and unhygienic use of a cylindrical wipe container to provide a product that allows users to easily and hygienically use wipes.

Generally, regarding wet wipes, a plurality of wipes in which a liquid cleaning solution is absorbed are rolled in a vertical cylindrical shape, and a wipe located at an upper end is sequentially withdrawn one at a time through a withdrawal hole formed in an upper surface of a wipe container.

Also, a portion surrounding the withdrawal hole is sealed from the outside through a separate opening/closing device and opened every time a wet wipe is withdrawn. In this way, evaporation of moisture from the wet wipes is minimized.

In such a structure, as a method of withdrawing a wet wipe, in a state in which the portion surrounding the withdrawal hole is opened using the opening/closing device, fingers are put into the withdrawal hole to hold a wipe located at the uppermost end and then pull the wipe upward to withdraw the wipe.

In this process, below the wipe that is completely withdrawn to the outside of the withdrawal hole (hereinafter, referred to as "completely withdrawn wipe"), a portion of an upper end of a wipe connected directly below the completely withdrawn wipe (hereinafter, referred to as "partially withdrawn wipe") is withdrawn to the outside of the withdrawal hole together with the completely withdrawn wipe. Accordingly, while the completely withdrawn wipe is completely withdrawn from the withdrawal hole, the upper end portion of the partially withdrawn wipe is partially withdrawn to the outside of the withdrawal hole.

Since the completely withdrawn wipe and the partially withdrawn wipe, which is connected directly below the completely withdrawn wipe, are connected via perforations, the completely withdrawn wipe and the partially withdrawn wipe are disconnected as soon as the upper end portion of the partially withdrawn wipe is partially withdrawn to the outside of the withdrawal hole.

The upper end portion of the partially withdrawn wipe being partially withdrawn to the outside of the withdrawal hole in the complete withdrawal process of the completely withdrawn wipe is possible because the wipes are rolled into a cylinder in a cylindrical container. The wipes are withdrawn in the above-described manner to, after the withdrawal of the completely withdrawn wipe, facilitate the withdrawal of a subsequent wipe.

SUMMARY OF THE INVENTION

The present disclosure is directed to providing a wipe container allowing a cleaning wipe to be withdrawn without contact and a sealing method thereof in which, when using a cylindrical container, a user is able to easily take out a first wipe of a nonwoven roll placed inside the cylindrical container through a lid of the cylindrical container even without directly touching the nonwoven roll with his or her fingers so that the user is able to hygienically use wet wipes, cleaning wipes, or sanitizing wipes.

The present disclosure is also directed to providing a wipe container allowing a cleaning wipe to be withdrawn without contact and a sealing method thereof in which direct use of fingers is unnecessary because a function of holding the first wipe and pushing out the first wipe through a hole in an upper portion of the lid is provided.

The present disclosure is also directed to providing a wipe container allowing a cleaning wipe to be withdrawn without contact and a sealing method thereof in which a wipe withdrawal member is installed inside the cylindrical container to allow a cleaning wipe to be withdrawn without separate direct contact.

However, the objectives of the present disclosure are not limited to those mentioned above, and other unmentioned objectives should be clearly understood by those of ordinary skill in the art to which the present disclosure pertains from the description below.

One aspect of the present disclosure provides a wipe container allowing a cleaning wipe to be withdrawn without contact, the wipe container including a container main body configured to provide a space in which the cleaning wipe is stored, a container cover detachably coupled to an upper portion of the container main body to seal the container main body and control opening and closing of the container main body, a sub-cover provided in a portion of the container cover and whose opening and closing is controlled by pressure caused by an external force to seal the container main body, and withdrawal tongs inserted into the container main body due to having a portion coupled to the sub-cover and configured to be caught on the cleaning wipe accommodated in the container main body, wherein the withdrawal tongs include a coupling portion manufactured in a shape that corresponds to the sub-cover and detachably coupled to the sub-cover, a hook formed to protrude from a portion of a lower portion of the coupling portion and inserted into the container main body to hold the cleaning wipe, and a withdrawal tongs handle formed to protrude in a predetermined shape from an upper portion of the coupling portion so as to be held.

Also, the sub-cover may include an intermediate stopper installed in a portion of the container cover so as to be pressed or lifted by pressure caused by an external force to seal or open the container cover, and a stopper accommodating portion which has a shape that corresponds to the intermediate stopper, is installed in a portion of the container cover, has the intermediate stopper sealably coupled thereto, and has a cross-shaped hole formed in a portion thereof.

Also, the hook may be formed in a straight shape or a folded shape and may be inserted into the container main body through the cross-shaped hole.

Also, a plurality of hooks having an elastic force may be formed on a portion of the hook.

Also, the withdrawal tongs may be manufactured using a polymer resin having an elastic force.

Also, an adhesive or a double-sided tape may be provided on the lower portion of the coupling portion so that the coupling portion is coupled to an upper surface of the stopper accommodating portion and seals the container main body.

Another aspect of the present disclosure provides a method of sealing a wipe container allowing a cleaning wipe to be withdrawn without contact, the method including a cleaning wipe inserting step of, in a wipe container having a configuration including a container main body, a container cover, a sub-cover, and withdrawal tongs, inserting cleaning wipes into the container main body, a withdrawal tongs coupling step of, after the cleaning wipe inserting step, coupling the withdrawal tongs to an upper surface of a stopper accommodating portion of the sub-cover using an adhesive or a double-sided tape provided on a lower portion of a coupling portion of the withdrawal tongs and sealing the container main body, a withdrawal tongs inserting step of, after the withdrawal tongs coupling step, inserting a hook of the withdrawal tongs into the center of the cleaning wipes accommodated in the container main body through a cross-shaped hole formed in the stopper accommodating portion of the sub-cover, and a wipe container sealing step of, after the withdrawal tongs inserting step, coupling the container cover to the container main body to seal the wipe container.

BRIEF DESCRIPTION OF THE DRAWINGS

The above and other objects, features and advantages of the present disclosure will become more apparent to those of ordinary skill in the art by describing exemplary embodiments thereof in detail with reference to the accompanying drawings, in which.

DETAILED DESCRIPTION OF EXEMPLARY EMBODIMENTS

Hereinafter, exemplary embodiments of the present disclosure will be described in detail with reference to the accompanying drawings to allow those of ordinary skill in the art to which the present disclosure pertains to easily carry out the present disclosure. However, since the description of the present disclosure only provides embodiments for structural or functional description, the scope of the present disclosure should not be interpreted as being limited by the embodiments described herein. That is, since the embodiments may be modified in various ways and may have various forms, the scope of the present disclosure should be understood as including equivalents that may realize the technical spirit of the present disclosure. Also, since the objectives or advantageous effects proposed in the present disclosure do not indicate that a specific embodiment should include all of them or only some of them, the scope of the present disclosure should not be understood as being limited thereby.

Terms used herein should be understood as follows.

Terms such as first and second are used to distinguish one element from another element, and the scope of the present disclosure should not be limited by the terms. For example, a first element may be referred to as a second element, and likewise, a second element may also be referred to as a first element. When it is mentioned that a certain element is "connected" to another element, although the certain element may be directly connected to the other element, it should be understood that another element may be present therebetween. On the other hand, when it is mentioned that a certain element is "directly connected" to another element, it should be understood that other elements are not present therebetween. Meanwhile, other expressions used to describe a relationship between elements, i.e., "between" and "directly between" or "adjacent" and "directly adjacent," should be interpreted likewise.

A singular expression should be understood as including a plural expression unless the context clearly indicates otherwise, and terms such as "include" or "have" should be understood as designating that features, number, steps, operations, elements, parts, or combinations thereof are present and not as precluding the possibility of the presence or addition of one or more other features, numbers, steps, operations, elements, parts, or combinations thereof in advance.

Unless otherwise defined, all terms used herein have the same meaning as commonly understood by those of ordinary skill in the art to which the present disclosure pertains. Terms, such as those defined in commonly used dictionaries, should be construed as having a meaning that is consistent with their meaning in the context of the relevant art and are not to be construed in an idealized or overly formal sense unless expressly so defined herein.

Figure 1:
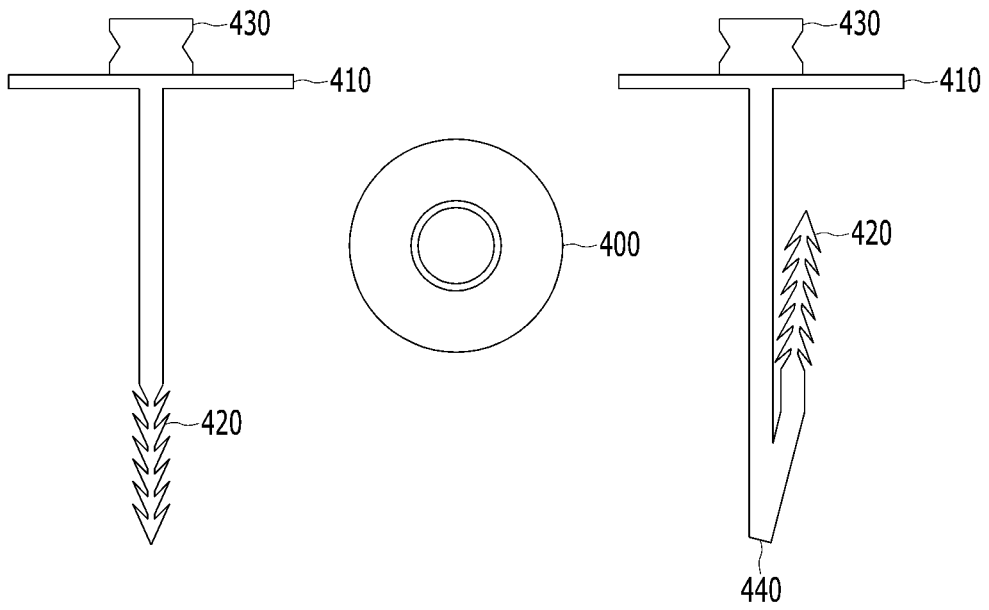
FIG. 1 is a conceptual diagram of withdrawal tongs provided in a wipe container allowing a cleaning wipe to be withdrawn without contact according to an embodiment of the present disclosure.
Figure 2:
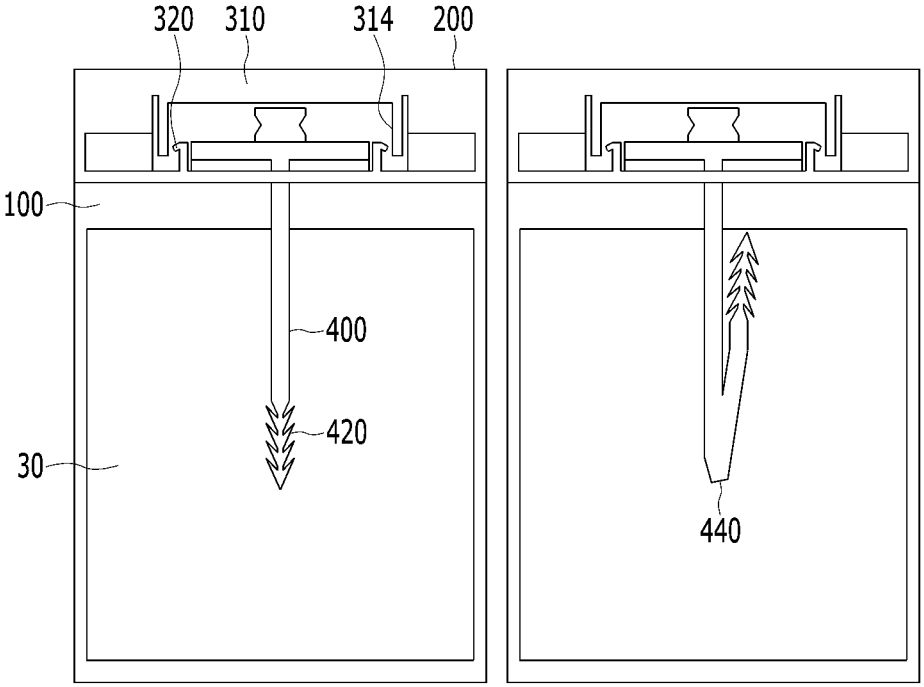
FIG. 2 is a view illustrating a state in which the withdrawal tongs of FIG. 1 are inserted into the wipe container.
Figure 3:
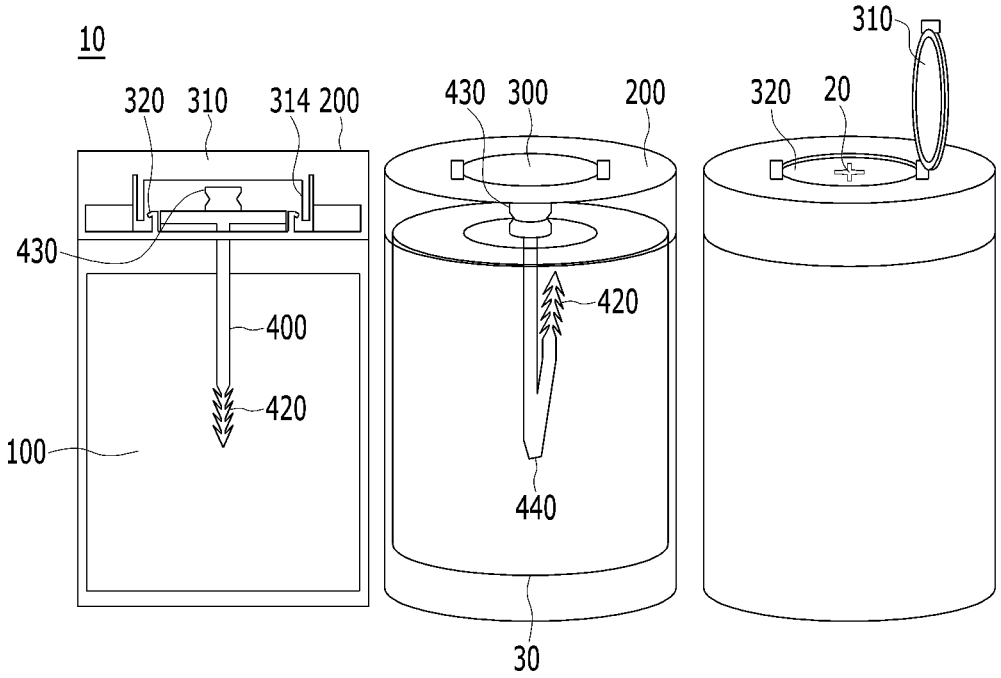
FIG. 3 is a conceptual diagram of the wipe container allowing a cleaning wipe to be withdrawn without contact according to an embodiment of the present disclosure.
Figure 4:
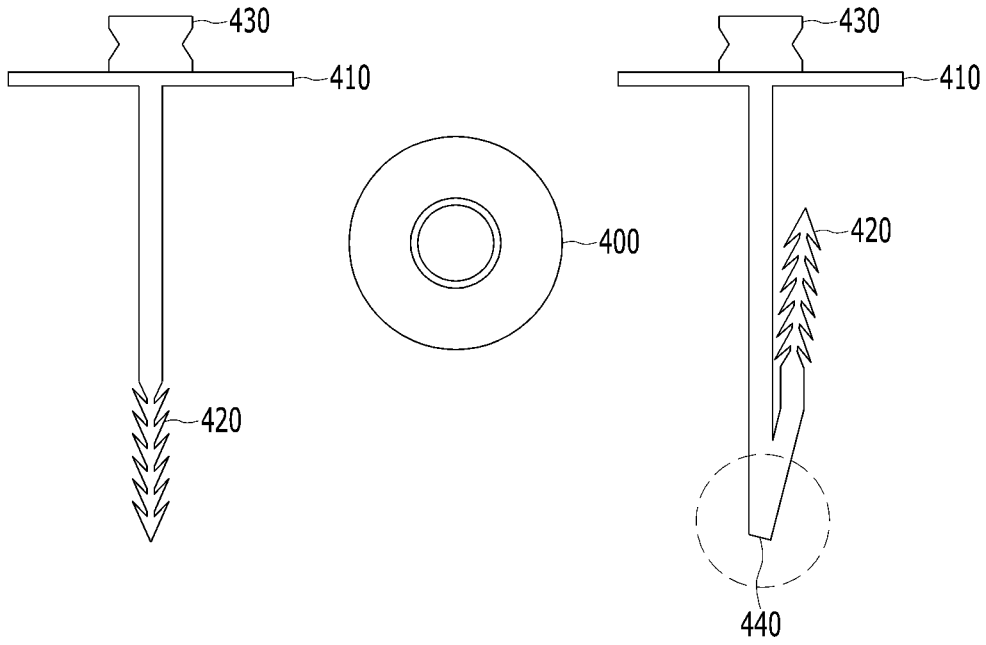
FIG. 4 is a detailed view of the withdrawal tongs.
Figure 5:
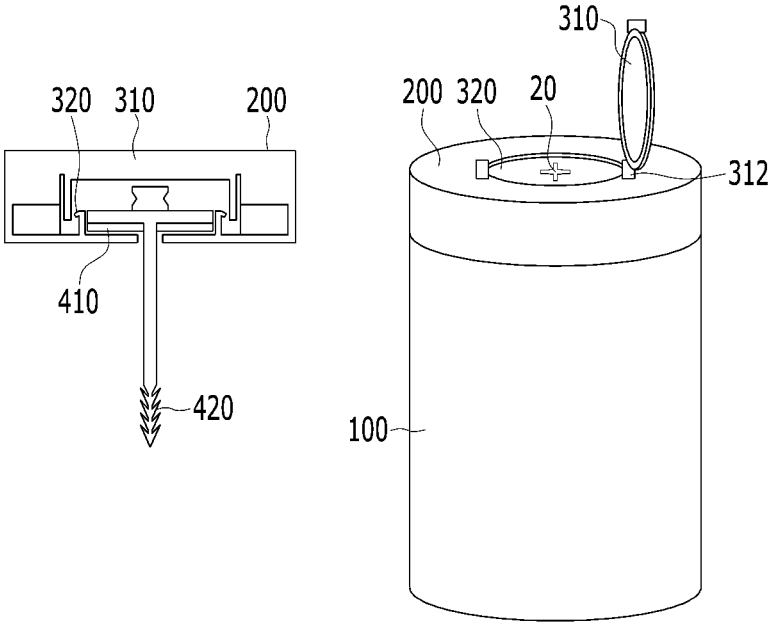
FIG. 5 is a view illustrating a state in which a sub-cover is mounted in a container cover.
Figure 6:
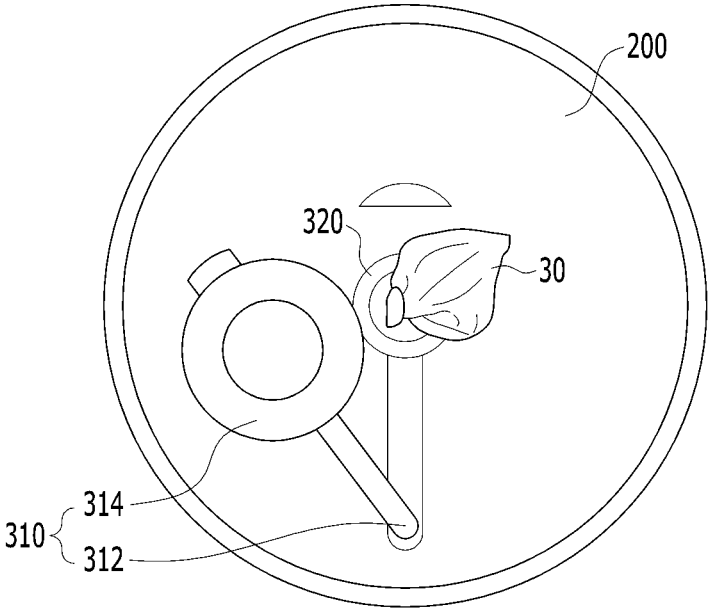
FIG. 6 is a view illustrating an embodiment of the wipe container.
Figure 7:
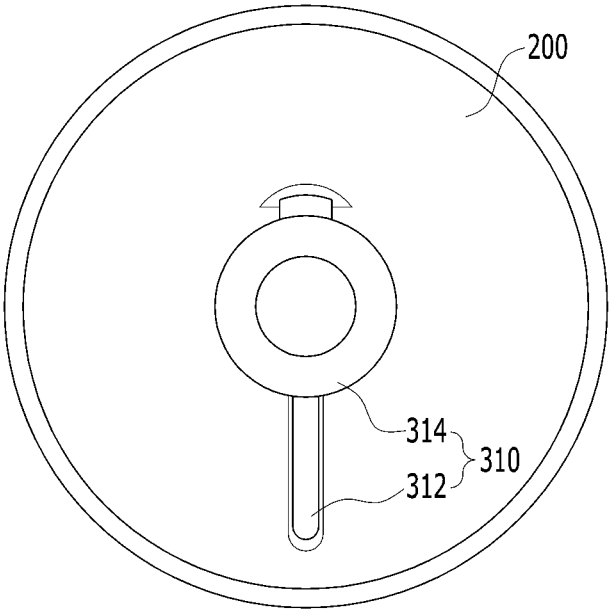
FIG. 7 is a plan view illustrating an upper portion of the wipe container.

FIG. 1 is a conceptual diagram of withdrawal tongs provided in a wipe container allowing a cleaning wipe to be withdrawn without contact according to an embodiment of the present disclosure, FIG. 2 is a view illustrating a state in which the withdrawal tongs of FIG. 1 are inserted into the wipe container, FIG. 3 is a conceptual diagram of the wipe container allowing a cleaning wipe to be withdrawn without contact according to an embodiment of the present disclosure, FIG. 4 is a detailed view of the withdrawal tongs, FIG. 5 is a view illustrating a state in which a sub-cover is mounted in a container cover, FIG. 6 is a view illustrating an embodiment of the wipe container, and FIG. 7 is a plan view illustrating an upper portion of the wipe container.

As illustrated in FIGS. 1 to 7, a wipe container 10 allowing a cleaning wipe to be withdrawn without contact according to the present disclosure may include a container main body 100, a container cover 200, a sub-cover 300, and withdrawal tongs 400.

The container main body 100 may provide a space in which a cleaning wipe 30 is stored. Specifically, the container main body 100 may be manufactured in a cylindrical shape, and the cleaning wipe 30 manufactured using a kind of nonwoven fabric or the like that is rolled into a cylinder may be stored in the container main body 100. In this way, not only is it possible to efficiently accommodate a greater number of cleaning wipes 30, but it is also possible to improve adhesion between the cleaning wipes 30 densely stored in a cylindrical shape and thus facilitate the cleaning wipe 30 being caught on a hook 420.

The container cover 200 may be detachably coupled to an upper portion of the container main body 100 to seal the container main body 100 and control opening and closing of the container main body 100. Specifically, the container cover 200 is manufactured in a circular shape, which corresponds to the container main body 100, and has screw threads formed on an inner side thereof to be detachably coupled to screw threads formed to correspond thereto on an outer side of the upper portion of the container main body 100. Thus, the container cover 200 may improve a sealing force of the wipe container 10, may block contact between the cleaning wipe 30 and outside air to prevent the cleaning wipe 30 from drying, and may facilitate storage of the cleaning wipe 30.

The sub-cover 300 is provided in a portion of the container cover 200, and the opening and closing of the sub-cover 300 may be controlled by pressure caused by an external force to seal the container main body 100. That is, by sealing the container main body 100 through opening and closing the sub-cover 300, the cleaning wipe 30 accommodated in the container main body 100 may be prevented from drying. Also, more firm sealing of the sub-cover 300 may be induced through a sealing member or the like which will be described below.

The sub-cover 300 may include an intermediate stopper 310 and a stopper accommodating portion 320.

The intermediate stopper 310 may be installed in a portion of the container cover 200 so as to be pressed or lifted by pressure caused by an external force to seal or open the container cover 200. Specifically, the intermediate stopper 310 may be manufactured in a shape in which a connecting portion 312, which is one end, is connected to a portion of the container cover 200 and, at the other end, an opening/closing portion 314 whose shape corresponds to the stopper accommodating portion 320 may be coupled to the stopper accommodating portion 320. Therefore, the connecting portion 312 may, by a hinge action, lift or lower the opening/closing portion 314 to control the opening and closing of the stopper accommodating portion 320 by pressure caused by an external force. The opening/closing portion 314 may be manufactured in a shape in which a portion surrounds an outer side of the stopper accommodating portion 320 formed to protrude upward. Thus, the portion of the opening/closing portion 314 may, while surrounding the stopper accommodating portion 320, seal the stopper accommodating portion 320 and be coupled thereto.

The stopper accommodating portion 320 may be installed in a portion of the container cover 200 in a shape that corresponds to the intermediate stopper 310, have the intermediate stopper 310 sealably coupled thereto, and have a cross-shaped hole 20 formed in a portion thereof. Specifically, the stopper accommodating portion 320 may be manufactured in a shape that corresponds to the opening/closing portion 314 of the intermediate stopper 310 and keep the wipe container 10 sealed through coupling of the opening/closing portion 314. Also, since the cross-shaped hole 20 is formed in the stopper accommodating portion 320, the hook 420 of the withdrawal tongs 400 may be inserted through the cross-shaped hole 20, a path for withdrawing the cleaning wipe 30 may be provided, and an upper surface of the stopper accommodating portion 320 in which the cross-shaped hole 20 is formed may provide a space in which a coupling portion 410 of the withdrawal tongs 400 is coupled.

The withdrawal tongs 400 may be inserted into the container main body 100 due to having a portion coupled to the sub-cover 300 and may be caught on the cleaning wipe 30 accommodated in the container main body 100. Using the withdrawal tongs 400, the cleaning wipe 30 accommodated in the container main body 100 may be withdrawn without a user separately coming in contact with the cleaning wipe 30.

The withdrawal tongs 400 may include the coupling portion 410, the hook 420, and a withdrawal tongs handle 430.

The coupling portion 410 may be manufactured in a shape that corresponds to the sub-cover 300 and detachably coupled to the sub-cover 300.

An adhesive or a double-sided tape may be provided on a lower portion of the coupling portion 410 so that the coupling portion 410 is coupled to an upper surface of the stopper accommodating portion 320 and seals the container main body 100. Here, the double-sided tape or the like may be adhered using ultrasonic waves.

That is, the coupling portion 410 may have a shape that corresponds to the stopper accommodating portion 320 and may have an adhesive or a double-sided tape provided on the lower portion so as to be coupled to the upper surface of the stopper accommodating portion 320. Specifically, the coupling portion 410 may be manufactured in a shape that constitutes a head portion, which is the upper portion, of the withdrawal tongs 400 and corresponds to the stopper accommodating portion 320, and due to the adhesive or double-sided tape provided on the lower portion of the coupling portion 410, the coupling portion 410 may be adhered and coupled to the upper surface of the stopper accommodating portion 320.

The withdrawal tongs handle 430 may be formed to protrude in a predetermined shape from an upper portion of the coupling portion 410 so as to be held.

The hook 420 may be formed to protrude from a portion of a lower portion of the coupling portion 410 and inserted into the container main body 100 to hold the cleaning wipe 30. That is, the hook 420 may be formed to protrude from the portion of the lower portion of the coupling portion 410 and may be inserted into the center of the cleaning wipes 30 while being accommodated in the container main body 100 through the cross-shaped hole 20.

The hook 420 may be formed in a straight shape or a folded shape and may be inserted into the container main body 100 through the cross-shaped hole 20.

A plurality of hooks having an elastic force may be formed on the hook 420.

Specifically, in a state in which the plurality of hooks having an elastic force are formed on the hook 420, the hook 420 may be inserted into the container main body 100 through the cross-shaped hole 20 and be caught on the cleaning wipe 30 so as to prepare for withdrawal of the cleaning wipe 30. That is, the hook 420 is inserted into the central portion of the cleaning wipes 30 that are stored in the form of a roll in the container main body 100 while being concentric therewith and is caught on the cleaning wipe 30 constituting the central portion so that a first cleaning wipe 30 is withdrawn by pressure caused by an external force, and then, another cleaning wipe 30 adjacent to the first cleaning wipe 30 may also be continuously withdrawn before a perforated connection line between the cleaning wipes 30 is disconnected. In this way, the cleaning wipe 30 may be withdrawn without a user separately coming in contact with the cleaning wipe 30.

That is, in the process in which the cleaning wipe 30 is completely withdrawn, a portion of an upper end of the first cleaning wipe 30 is withdrawn to the outside of the cross-shaped hole 20 due to the hook 420 because the cleaning wipes 30 are rolled into a cylinder in the container main body 100. Thus, after the first cleaning wipe 30 is withdrawn using the hook 420, a subsequent cleaning wipe 30 may be easily withdrawn.

The withdrawal tongs 400 may be manufactured using a polymer resin having an elastic force. Specifically, the withdrawal tongs 400 may be manufactured using a polymer resin that has excellent durability and elasticity. Examples of the polymer resin include phenol resin, polyurethane resin, polyamide resin, acrylic resin, urea-melamine resin, silicone resin, and the like.

According to an embodiment of the present disclosure, the wipe container allowing a cleaning wipe to be withdrawn without contact is the cylindrical wipe container 10 that allows a user to easily withdraw the first cleaning wipe 30, which is inside the wipe container 10, to above the container cover 200 without touching the cleaning wipe 30 with his or her fingers. In the wipe container 10, the container cover 200 may be inserted into an upper surface of the container main body 100 and have the cross-shaped hole 20 formed therein to allow the cleaning wipe 30 to pass, the intermediate stopper 310 configured to prevent the cleaning wipe 30 from drying due to contact with outside air may be disposed on an upper surface of the container cover 200, the withdrawal tongs 400 for withdrawing the first cleaning wipe 30 may be inserted to a portion below the intermediate stopper 310 through an upper portion of the cross-shaped hole 20, and the hook 420 may be caught on an upper portion of the cleaning wipe 30 disposed in the container main body 100. The hook 420 may be made of a polymer resin such as plastic having elasticity so that the cleaning wipe 30 is caught on the hook 420.

Also, the hook 420 of the withdrawal tongs 400 may have a plurality of hooks formed thereon, and according to the height of the container main body 100, the purpose of use, or the like, the hook 420 may be folded in half or a length of the hook 420 may be adjusted. That is, in order to allow the length of the hook 420 to be maximized, the hook 420 may be folded and then inserted into the container main body 100.

Figure 8:
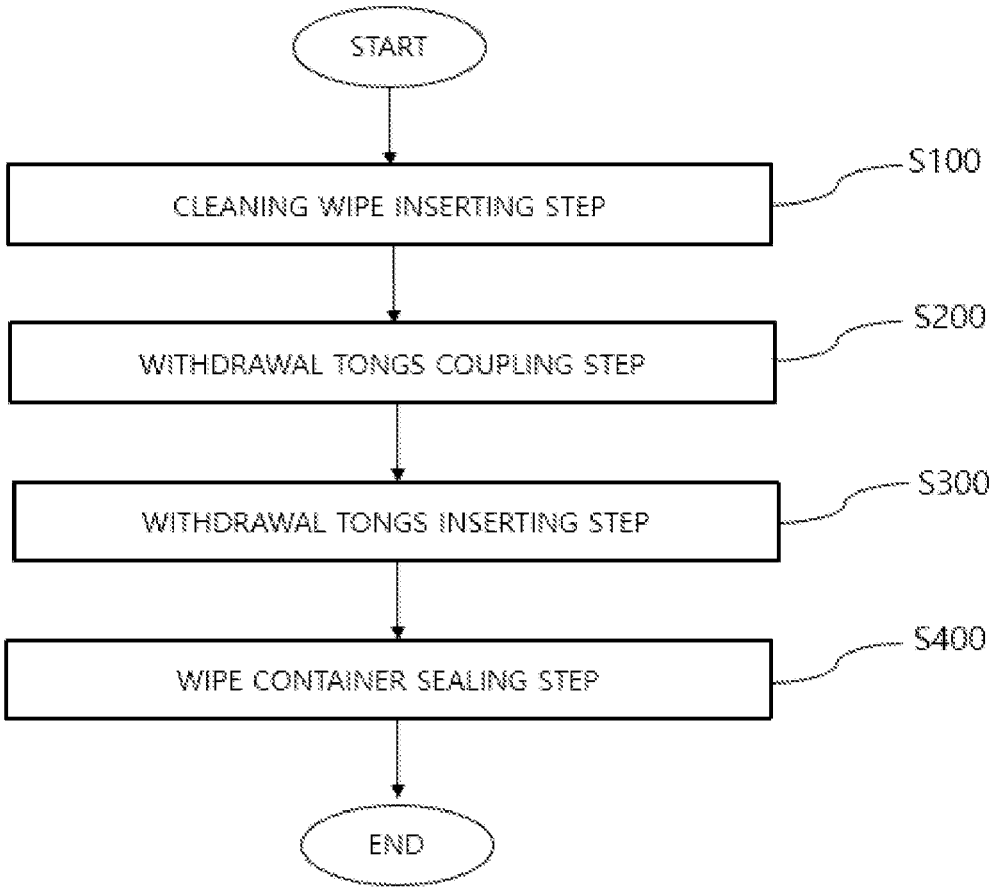
FIG. 8 is a flowchart of a method of sealing a wipe container allowing a cleaning wipe to be withdrawn without contact according to another embodiment of the present disclosure.

FIG. 8 is a flowchart of a method of sealing a wipe container allowing a cleaning wipe to be withdrawn without contact according to another embodiment of the present disclosure.

As illustrated in FIG. 8, a method of sealing the above-described wipe container allowing a cleaning wipe to be withdrawn without contact according to the present disclosure may include a cleaning wipe inserting step (S100), a withdrawal tongs coupling step (S200), a withdrawal tongs inserting step (S300), and a wipe container sealing step (S400).

The cleaning wipe inserting step (S100) is a step of, in a wipe container 10 having a configuration including a container main body 100, a container cover 200, a sub-cover 300, and withdrawal tongs 400, inserting cleaning wipes 30 into the container main body 100.

The withdrawal tongs coupling step (S200) is a step of, after the cleaning wipe inserting step (S100), coupling the withdrawal tongs 400 to an upper surface of a stopper accommodating portion 320 of the sub-cover 300 using an adhesive or a double-sided tape provided on a lower portion of a coupling portion 410 of the withdrawal tongs 400 and sealing the container main body 100.

The withdrawal tongs inserting step (S300) is a step of, after the withdrawal tongs coupling step (S200), inserting a hook 420 of the withdrawal tongs 400 into the center of the cleaning wipes accommodated in the container main body 100 through a cross-shaped hole 20 formed in the stopper accommodating portion 320 of the sub-cover 300.

The wipe container sealing step (S400) is a step of, after the withdrawal tongs inserting step (S300), coupling the container cover 200 to the container main body 100 to seal the wipe container 10.

Specific elements are the same as those described above in relation to the wipe container 10.

According to an embodiment of the present disclosure, the withdrawal tongs 400 configured to withdraw the cleaning wipe 30 from inside the cylindrical container main body 100 are used instead of using fingers. Thus, the first cleaning wipe 30 placed inside the cylindrical container main body 100 may be easily withdrawn to above the container cover 200 without fingers touching the cleaning wipe 30. In this way, convenience is provided such that wet wipes, cleaning wipes 30, sanitizing wipes or the like may be hygienically used.

Also, the withdrawal tongs 400 are simultaneously installed on the container cover 200 and seal the intermediate stopper 310 using an adhesive or a double-sided tape. Thus, it is possible to prevent the cleaning wipe 30 in the container main body 100 from drying.

According to an embodiment of the present disclosure, since withdrawal tongs configured to withdraw a cleaning wipe in a cylindrical container main body are used instead of using fingers, the first cleaning wipe placed inside the cylindrical container main body can be easily withdrawn to an upper portion of a container cover without fingers touching the cleaning wipe. In this way, there is an effect of providing convenience that allows wet wipes, cleaning wipes, or sanitizing wipes to be hygienically used.

Also, since the withdrawal tongs are installed on the container cover and seal an intermediate stopper using an adhesive or a double-sided tape at the same time, the cleaning wipe in the container main body can be prevented from drying.

However, the advantageous effects of the present disclosure are not limited to those mentioned above, and other unmentioned advantageous effects should be clearly understood by those of ordinary skill in the art to which the present disclosure pertains from the description herein.

The above detailed description of exemplary embodiments of the present disclosure has been provided to allow those of ordinary skill in the art to implement and carry out the present disclosure. Although the present disclosure has been described above with reference to the exemplary embodiments thereof, those of ordinary skill in the art should understand that various modifications and changes may be made to the present disclosure within the scope not departing from the range of the present disclosure. For example, those of ordinary skill in the art may combine different configurations described in the embodiments described above. Therefore, instead of being limited to the embodiments described herein, the present disclosure has the widest possible scope that is consistent with the principles and novel features disclosed herein.

The present disclosure may be embodied in other specific forms within the scope not departing from the spirit and essential features of the present disclosure. Therefore, the above detailed description should be considered illustrative, instead of limiting, in all aspects. The scope of the present disclosure should be determined by rational analysis of the claims, and all changes within the scope equivalent to the scope of the present disclosure fall within the scope of the present disclosure. The present disclosure is not limited to the embodiments described herein and has the widest possible scope that is consistent with the principles and novel features disclosed herein. Also, some of the claims that are not explicitly cited in relation to one another may be combined to constitute an embodiment, or a new claim may be included due to amendment after filing an application.

What is claimed is:

1. A wipe container allowing a cleaning wipe to be withdrawn without contact, the wipe container comprising:

a container main body configured to provide a space in which the cleaning wipe is stored;

a container cover detachably coupled to an upper portion of the container main body to seal the container main body and control opening and closing of the container main body;

a sub-cover provided in a portion of the container cover and whose opening and closing is controlled by pressure caused by an external force to seal the container main body; and withdrawal tongs inserted into the container main body due to having a portion coupled to the sub-cover and configured to be caught on the cleaning wipe accommodated in the container main body, wherein the withdrawal tongs include a coupling portion manufactured in a shape that corresponds to the sub-cover and detachably coupled to the sub-cover, a hook formed to protrude from a portion of a lower portion of the coupling portion and inserted into the container main body to hold the cleaning wipe, and a withdrawal tongs handle formed to protrude in a predetermined shape from an upper portion of the coupling portion so as to be held.

2. The wipe container of claim 1, wherein a plurality of hooks having an elastic force are formed on a portion of the hook.

3. The wipe container of claim 1, wherein the withdrawal tongs are manufactured using a polymer resin having an elastic force.

4. The wipe container of claim 1, wherein sub-cover includes:

an intermediate stopper installed in a portion of the container cover so as to be pressed or lifted by pressure caused by an external force to seal or open the container cover, and a stopper accommodating portion which has a shape that corresponds to the intermediate stopper, is installed in a portion of the container cover, has the intermediate stopper sealably coupled thereto, and has a cross-shaped hole formed in a portion thereof.

5. The wipe container of claim 4, wherein the hook is formed in a straight shape or a folded shape and is inserted into the container main body through the cross-shaped hole.

6. The wipe container of claim 4, wherein an adhesive or a double-sided tape is provided on the lower portion of the coupling portion so that the coupling portion is coupled to an upper surface of the stopper accommodating portion and seals the container main body.

7. A method of sealing a wipe container allowing a cleaning wipe to be withdrawn without contact of claim 1, the method comprising:

a cleaning wipe inserting step of, in a wipe container having a configuration including a container main body, a container cover, a sub-cover, and withdrawal tongs, inserting cleaning wipes into the container main body;

a withdrawal tongs coupling step of, after the cleaning wipe inserting step, coupling the withdrawal tongs to an upper surface of a stopper accommodating portion of the sub-cover using an adhesive or a double-sided tape provided on a lower portion of a coupling portion of the withdrawal tongs and sealing the container main body;

a withdrawal tongs inserting step of, after the withdrawal tongs coupling step, inserting a hook of the withdrawal tongs into the center of the cleaning wipes accommodated in the container main body through a cross-shaped hole formed in the stopper accommodating portion of the sub-cover; and a wipe container sealing step of, after the withdrawal tongs inserting step, coupling the container cover to the container main body to seal the wipe container.

8. The method of claim 7, wherein sub-cover includes:

an intermediate stopper installed in a portion of the container cover so as to be pressed or lifted by pressure caused by an external force to seal or open the container cover, and a stopper accommodating portion which has a shape that corresponds to the intermediate stopper, is installed in a portion of the container cover, has the intermediate stopper sealably coupled thereto, and has a cross-shaped hole formed in a portion thereof.

9. The method of claim 8, wherein the hook is formed in a straight shape or a folded shape and is inserted into the container main body through the cross-shaped hole.

10. The method of claim 7, wherein a plurality of hooks having an elastic force are formed on a portion of the hook.

11. The method of claim 7, wherein the withdrawal tongs are manufactured using a polymer resin having an elastic force.

12. The method of claim 8, wherein an adhesive or a double-sided tape is provided on the lower portion of the coupling portion so that the coupling portion is coupled to an upper surface of the stopper accommodating portion and seals the container main body.

* * * * *